US005465673A

United States Patent [19]

Ma

[11] Patent Number: 5,465,673

[45] Date of Patent: Nov. 14, 1995

[54] COLLAPSIBLE STOOL OR TABLE APPARATUS WITH HANDLE PORTION

[76] Inventor: Mark Ma, 1415 Martens Dr., Hammond, La. 70401

[21] Appl. No.: 199,059

[22] Filed: Feb. 22, 1994

Related U.S. Application Data

[63] Continuation-in-part of Ser. No. 129,944, Sep. 30, 1993, abandoned.

[51] Int. Cl.[6] ..... A47B 3/02

[52] U.S. Cl. ..... 108/118; 108/132

[58] Field of Search ..... 108/118, 119, 108/131, 132, 133, 150; 297/4

[56] References Cited

U.S. PATENT DOCUMENTS

| | | | |
|---|---|---|---|
| 362,825 | 5/1887 | Eulass | 108/119 |
| 575,957 | 1/1897 | Kaiser | 108/131 X |
| 1,942,603 | 1/1934 | Johanson | 108/119 |
| 2,127,398 | 8/1980 | Freeman | 100/131 X |
| 2,727,564 | 12/1955 | Gruber | 108/118 X |
| 3,062,603 | 11/1962 | Kamenstein et al. | 108/118 X |
| 3,283,733 | 11/1966 | Boerma | 108/150 X |
| 4,557,200 | 12/1985 | Geschwender | 108/133 X |
| 4,728,118 | 3/1988 | Hass | 108/119 X |

*Primary Examiner*—Jose V. Chen

[57] ABSTRACT

A collapsible stool apparatus having a plurality of leg members attached to a wooden seat, and further including a swivel bracket for allowing the legs of the apparatus to be moved from a substantially flat, parallel closed position to an "X" configured open position. There is further included a handle member secured to the lower face of the seat for carrying the stool apparatus when it is in the closed position.

6 Claims, 7 Drawing Sheets

COLLAPSIBLE STOOL OR TABLE APPARATUS WITH HANDLE PORTION

This is a continuation-in-part application of prior, U.S. patent application Ser. No. 08/129,944, filed on Sep. 30, 1993, now abandoned, by the same inventor, presently pending and incorporated herein by reference.

BACKGROUND OF THE INVENTION

1. Field Of The Invention

The present invention relates to furniture. More particularly, the apparatus of the present invention relates to a collapsible stool apparatus having leg portions which may be placed in a first opened position for supporting a top surface, to a second collapsed position so that the top portion and the legs form a substantially vertical plane for easy compact storage.

2. General Background

In the field of furniture construction such as stools or tables or the like, it is important that these apparatuses have the ability to be stored and shipped within a confined space so as to avoid the high cost of shipping and storage. Therefore, it is a need in the art to have an apparatus such as a table or stool which may have the ability to be stored and shipped in a very compact configuration, with the legs and the table or stool top forming a substantially single, vertical plane so as to eliminate any bulky storage or the like.

Stools which fold are known in the art, and are generally constructed of metal having hinges and metallic legs so as to form the entire stool apparatus. In order to provide a more aesthetic piece of furniture, it is foreseen that an apparatus such as a foldable stool having legs constructed perhaps of metal, with a top constructed of wood would provide a support surface for the user, yet be pleasing to the eye in the area of household furniture.

SUMMARY OF THE PRESENT INVENTION

The apparatus of the present invention solves the shortcomings in the art in a simple and straight forward manner. What is provided is a support apparatus such as a stool or table having a bottom support portion configured of four legs formed in an "X" position when the legs are in the open configuration, with the lower portion of the legs forming a base for setting upon a surface such as a floor, and the upper portion supporting a flat seat portion. The seat would be constructed of wood, and would be hinged to the upper portion of one set of legs, so that when the legs move from the open "X" position to the flat closed position, the seat portion may hinge downward and fall in line with the vertically positioned legs. There would also be provided a handle member on the bottom of the seat so that when the apparatus is carried, it may be carried by the handle and when it is in the open position, the handle is formed beneath the seat portion, and therefore out of view.

Therefore, it is the principal object of the present invention to provide an aesthetically pleasing stool or table which may be constructed of metallic legs and a wooden support surface for household use;

It is a further object of the present invention to provide a collapsible stool apparatus so that the legs are constructed of metal and the seat is constructed of wood, and further including a handle on the lower portion of the seat for easy carrying;

It is a further object of the present invention to provide a piece of household furniture such as a stool, which may be stored and shipped in a very compact configuration, with the seat and the legs forming a single vertical plane for storage or shipment.

BRIEF DESCRIPTION OF THE DRAWINGS

For a further understanding of the nature and objects of the present invention, reference should be had to the following detailed description taken in conjunction with the accompanying drawings, in which like parts are given like reference numerals, and wherein.

DETAILED DESCRIPTION OF THE PREFERRED EMBODIMENT

Figure 1:
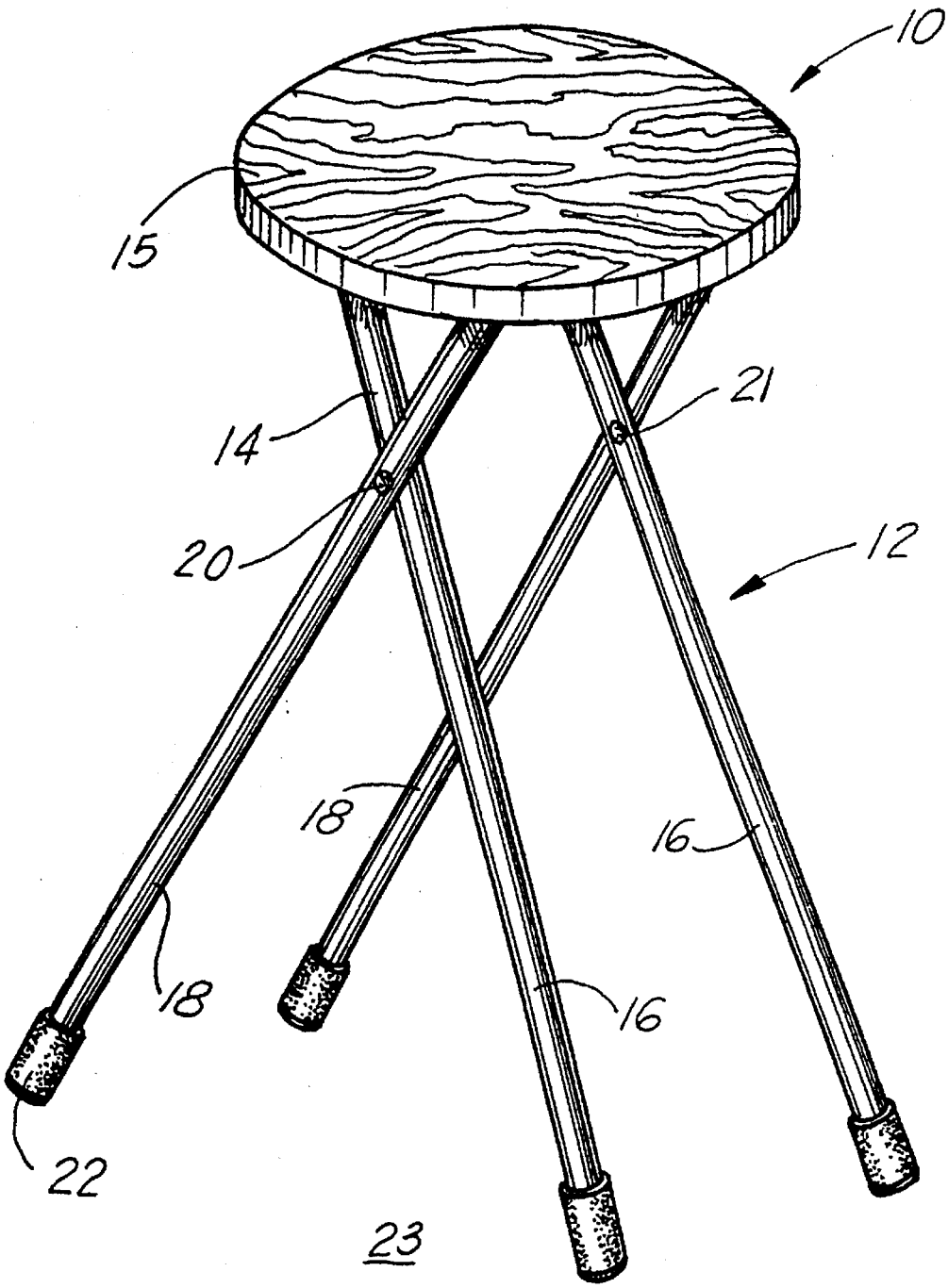
FIG. 1 illustrates an overall perspective view of the present invention.

FIGS. 1–15 illustrate the preferred embodiment of the apparatus of the present invention designated generally by the numeral 10. As illustrated, apparatus or stool 10 comprises a lower support means 12 and an upper, wooden top portion 15. Lower support means 12 would further comprise leg members 14, with leg members 14 including a first pair of parallel leg members 16 and a second pair of parallel leg members 18. The first pair 16 and second pair 18 would form an "X" configuration in the opened position as illustrated in FIG. 1 meeting at a common point 20 along their length, and forming a hinge member 21. At the lower end of the leg portions, there is further included a cap member 22 which serves to support the stool on a surface such as a floor 23. As illustrated in the open position in FIGS. 1 and 5, the lower ends of each of the leg members 14 are sufficiently spaced apart so as to form a solid support base for the stool apparatus as illustrated.

Figure 6:
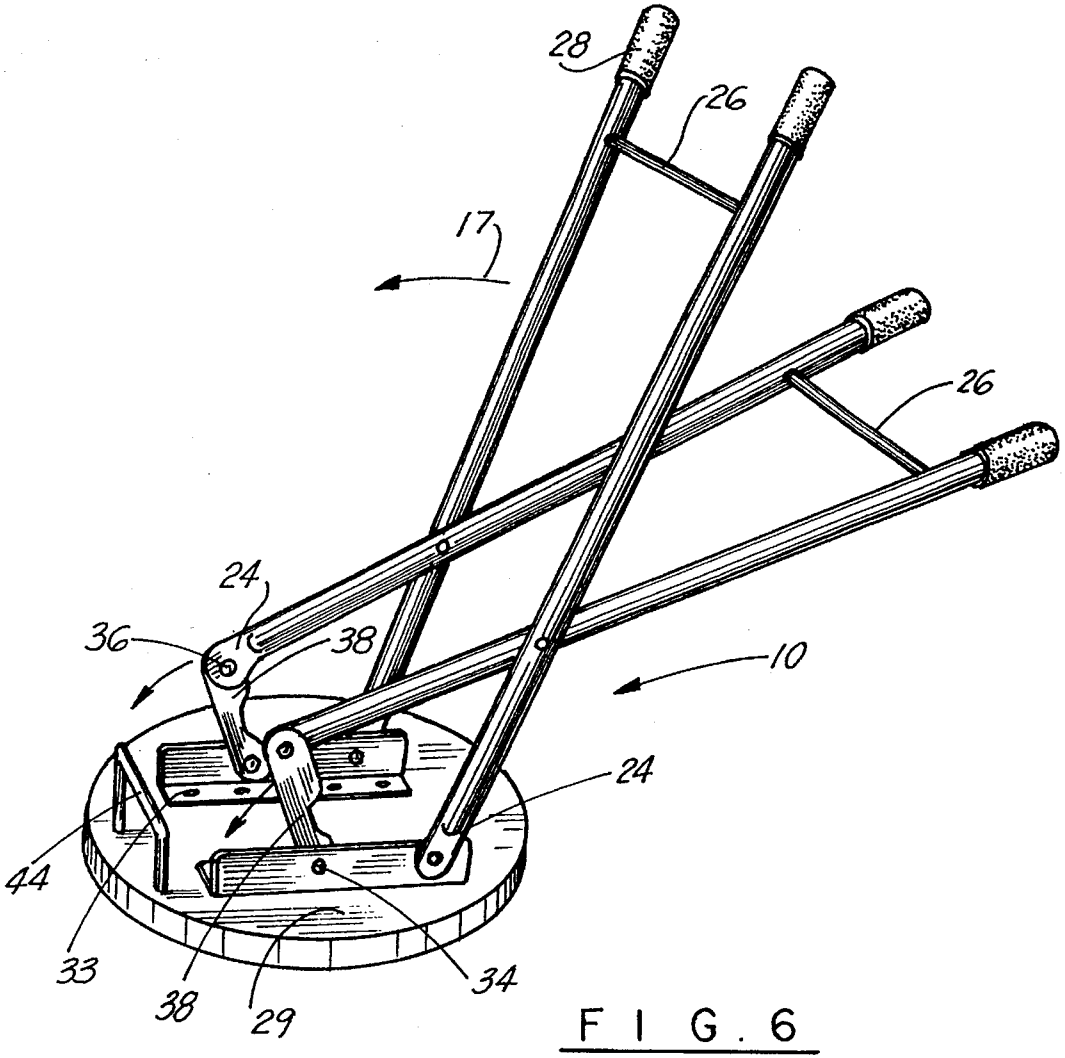
FIG. 6 illustrates an overall view of the apparatus of the present invention going from the closed to the fully opened position as illustrated in FIG. 5.

Turning now to the upper portion of the apparatus, there is illustrated the top portion 15 which would comprise generally a circular, oval or square shaped wooden support seat being of a thickness of approximately one inch, with the upper face 40 of the seat member 15, utilized to support a user, and the lower face 29 of seat member 15, utilized for attaching the support means 12, and for attaching a handle member 44, as illustrated more clearly in FIG. 6.

Turning now to the make-up of the support means 12, reference. is made to FIG. 6 where there is included a pair of mounting "L" brackets 32, attached to the lower face 29 of seat member 15 with a plurality of screws 33. Support brackets 32 would have a first swivel attachment 30 to the first pair 16 of leg members 14 which would allow a first pair of leg members 16 to swivel between opened and closed positions as illustrated by arrows 17. The upper ends 24 of first pair of legs 16 would be attached to a swivel plate 38. Swivel plate 38 including a first end swivelly attached to support bracket 32 at point 39, and the second end 41 attached to the upper end 24 of second pair of legs 18. As illustrated in FIG. 6, the stool would move to the opened position as seen in FIG. 5 by moving the support brackets in direction of arrows 43, and while in the opened position, would like flat in parallel relationship to support bracket 32 as seen in FIG. 5.

Figure 4:
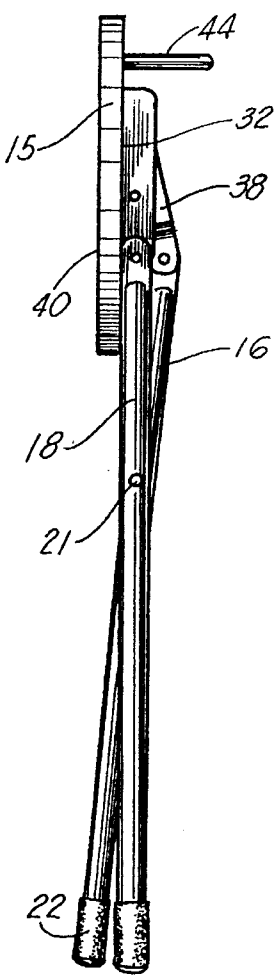
FIGS. 2–4 illustrate front, rear and side views respectively of the apparatus of the present invention in the closed position.
Figure 3:
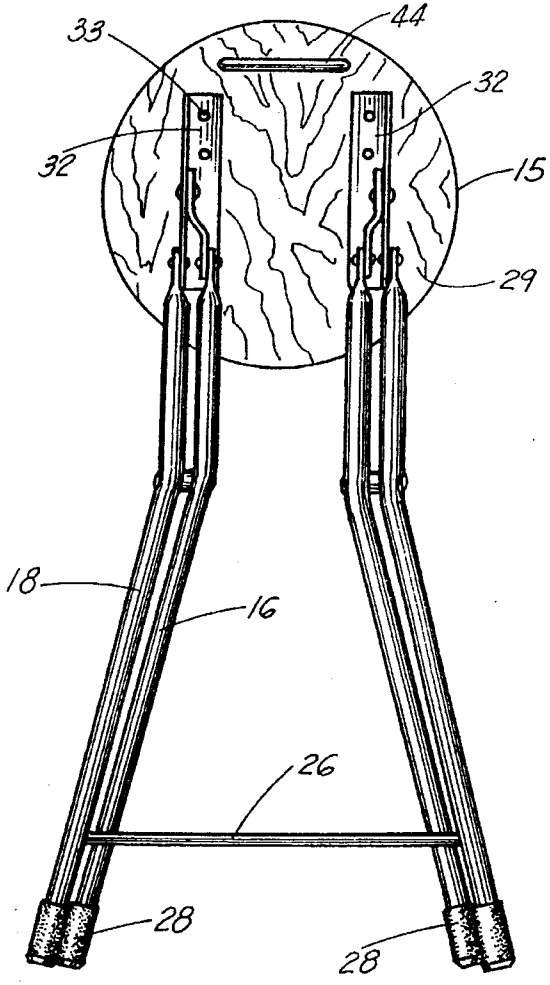

Moving from the opened to the closed position, first pair of legs 18 would be pulled in the direction of arrows 51, and swivel plates 38 would move upward so as to be positioned parallel with the leg members in the open position as seen in FIGS. 3 and 4. It is in this position that the apparatus could be utilized for storage or shipment.

Figure 5:
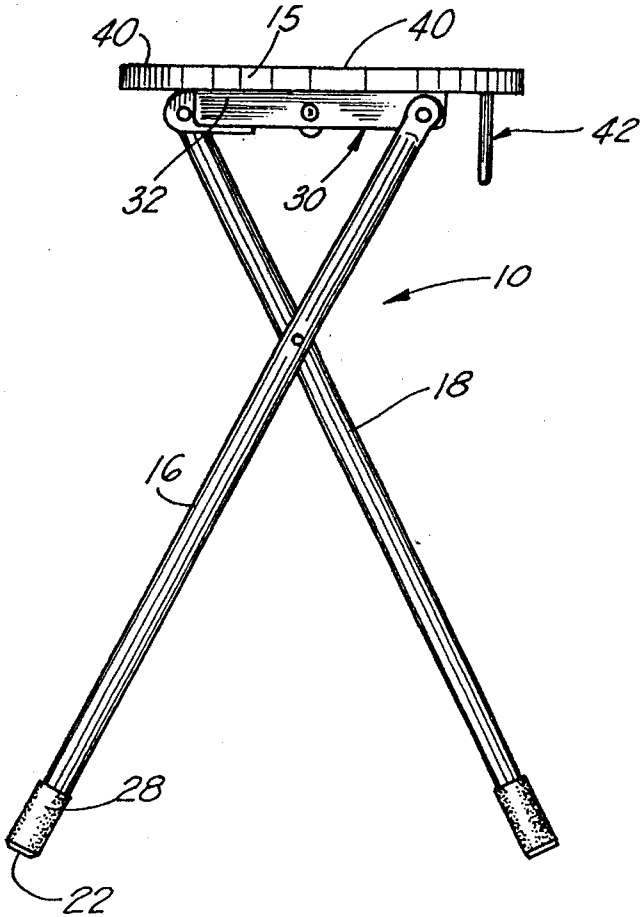
FIG. 5 illustrates a side view of the apparatus of the present invention in the opened position.
Figure 7:
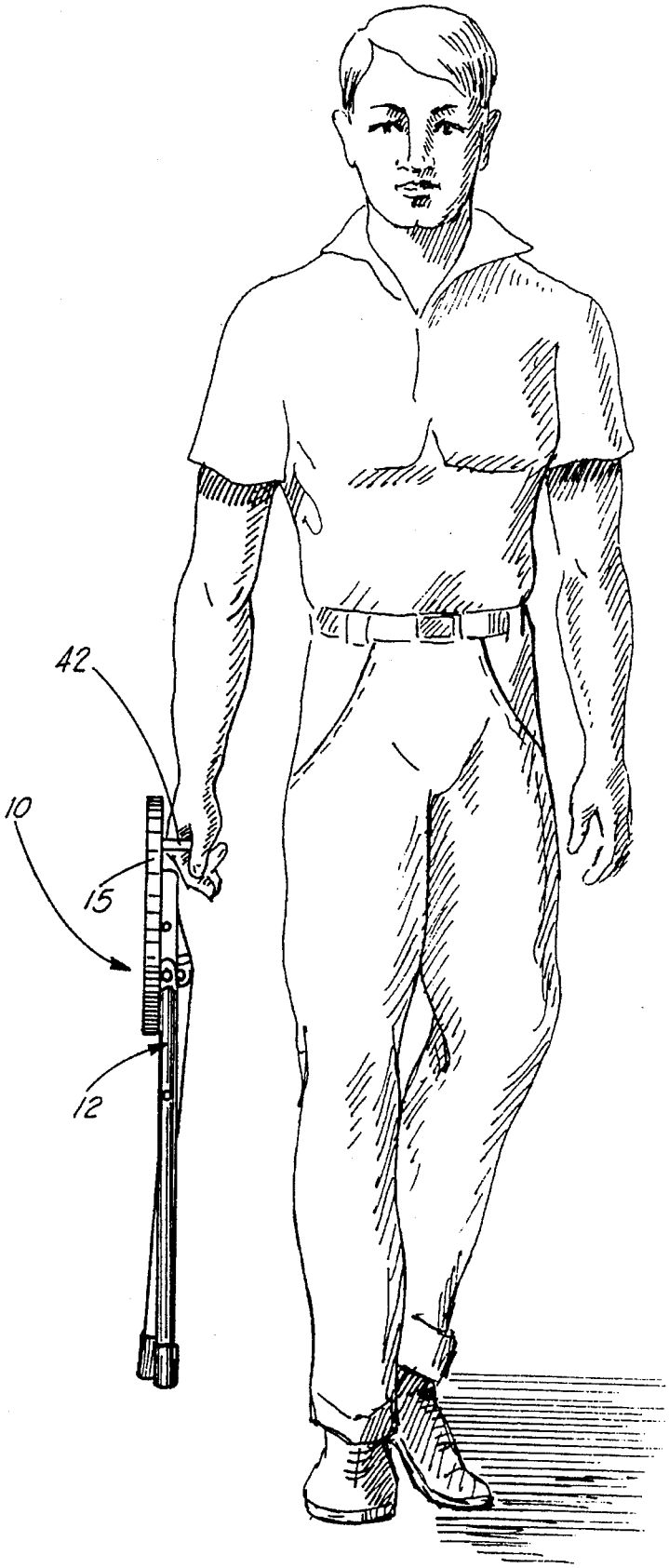
FIG. 7 illustrates a side view of the apparatus in the closed position being carried by a user of the apparatus.

Further, as seen in FIGS. 5 and 6, there would be included a handle means 42 which comprises a U-shaped handle 44 attached to the lower face 29 of seat 15, so that the apparatus could be carried by the user as seen in FIG. 7.

Figure 8:
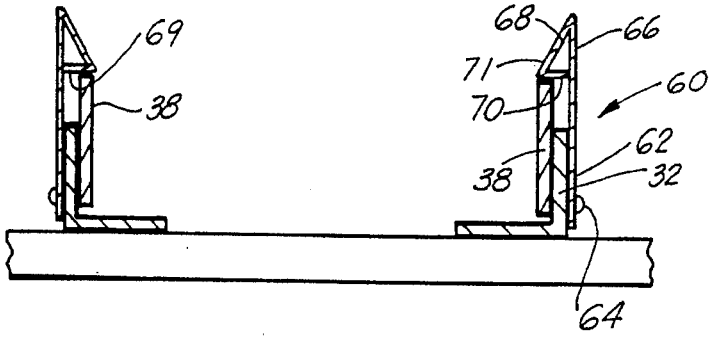
FIG. 8–10 illustrate views of the locking mechanism utilized in the preferred embodiment of the apparatus of the present invention.
Figure 9:
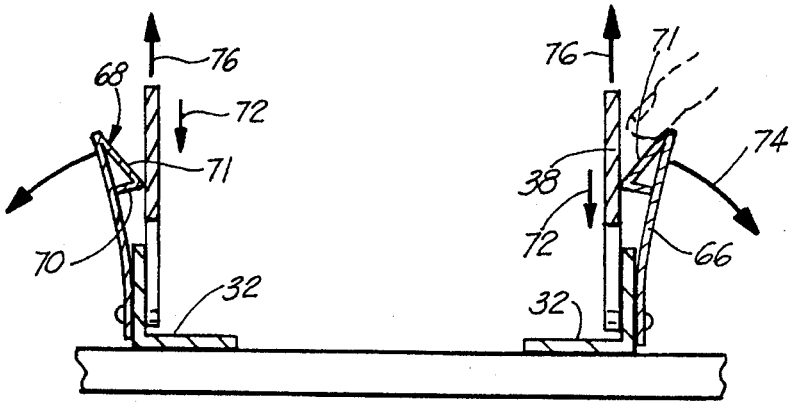
Figure 10:
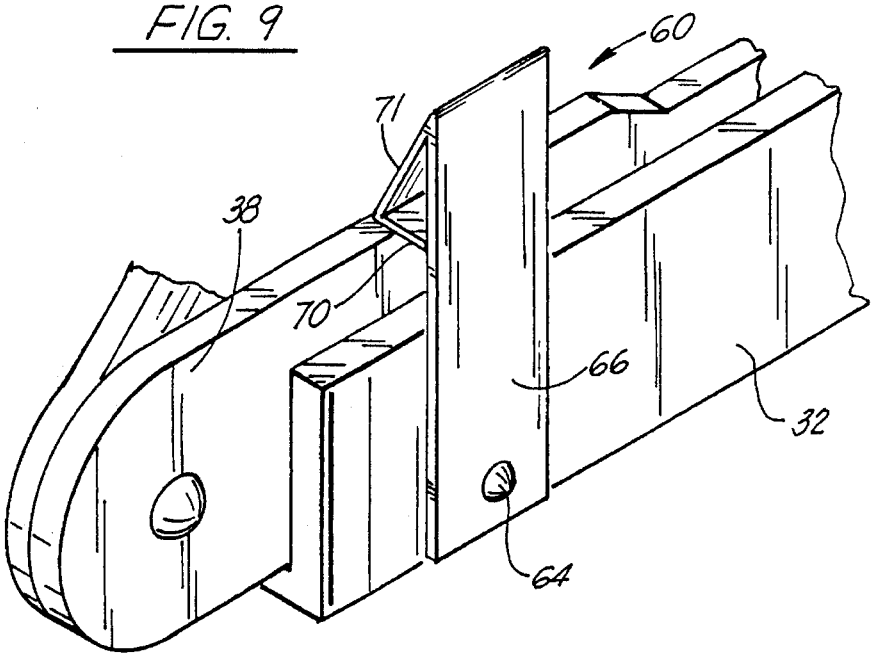

Reference is made to FIGS. 8–10 which illustrate a locking means for maintaining the seat locked in the open position as illustrated in FIG. 5. This means wold include a flexible locking member 60 engaged at its first end 62 to one wall of the L brackets 32 via a screw or the like 64. As seen in FIG. 1, bracket 60 would include an elongated body portion 66, terminating in a triangulated top portion 68, which would form a lower shoulder portion 70.

Figure 2:
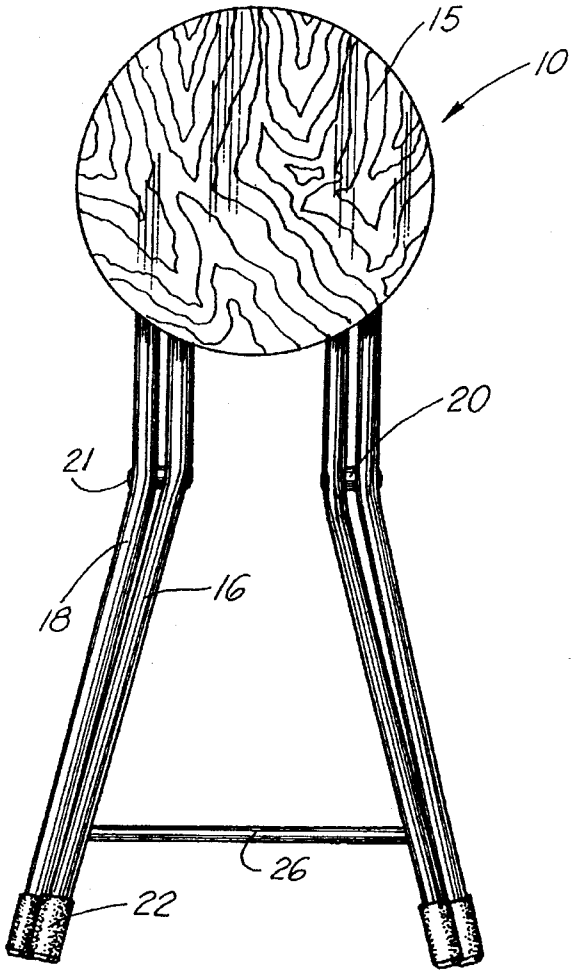

Turning now to FIG. 9, it is illustrated where the seat bracket 38 when moved in the direction of arrow 72 would slide along the beveled edge 71 of triangular member 68, and would force the body portion 66 in the direction of arrow 74, and once in position as seen in FIG. 8, the body 66 would flex back into the upright position, and the upper edge of member 38 would be locked in position against the lower face 70 of triangular portion 68 and would therefore be locked in the open position. In the event one would want to close the seat, one would simply have to put pressure on face 71 to move it rearward in the position as illustrated in FIG. 9, and the seat member would then be able to move in the direction of arrow 76 in order to move to the closed position as seen in FIGS. 1–3.

Figure 11:
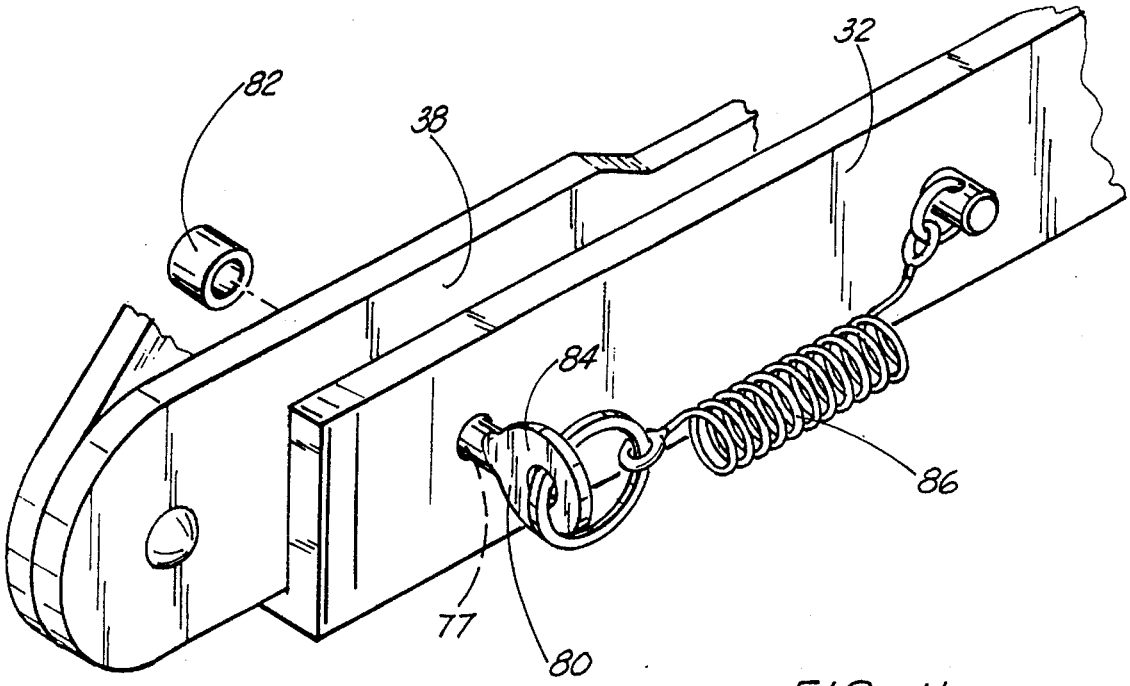
FIGS. 11 and 12 illustrate an additional embodiment of the locking mechanism in the preferred embodiment of the present invention.
Figure 12:
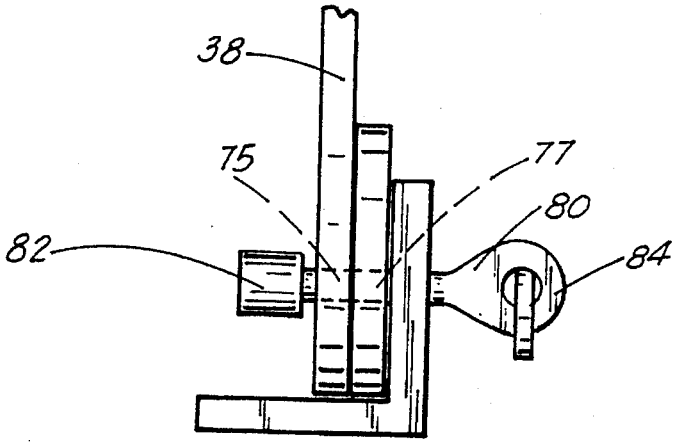

An additional locking means is illustrated in FIG. 11 where when the seat bracket 38 is in the position as illustrated in FIG. 8, there is included a bore 75 through the bracket 38 which would coincide with a bore 77 in the L bracket 32. A pin member 80 would then be slidingly engaged through both bores, and a cap 82 would then be placed on the end of the pin member 80 to hold it in place. The second end 84 of the pin member 80 would be attached to the L bracket 32 via a short spring or the like 86, so that when the pin member 80 is removed and the apparatus is allowed to move to the closed position, the pin lock is maintained on the chair.

As further illustrated, each of the pair of leg members at their lower end would further include a transverse support bar 26 for maintaining the leg members in the configuration as illustrated and to increase the support of the apparatus.

As was discussed earlier in the preferred embodiment, the apparatus would be constructed of a light-weight aluminum frame for the support means, but would include a high quality wood for the seat member with the frame being attached directly to the seat member via screwing or the like.

Figure 13:
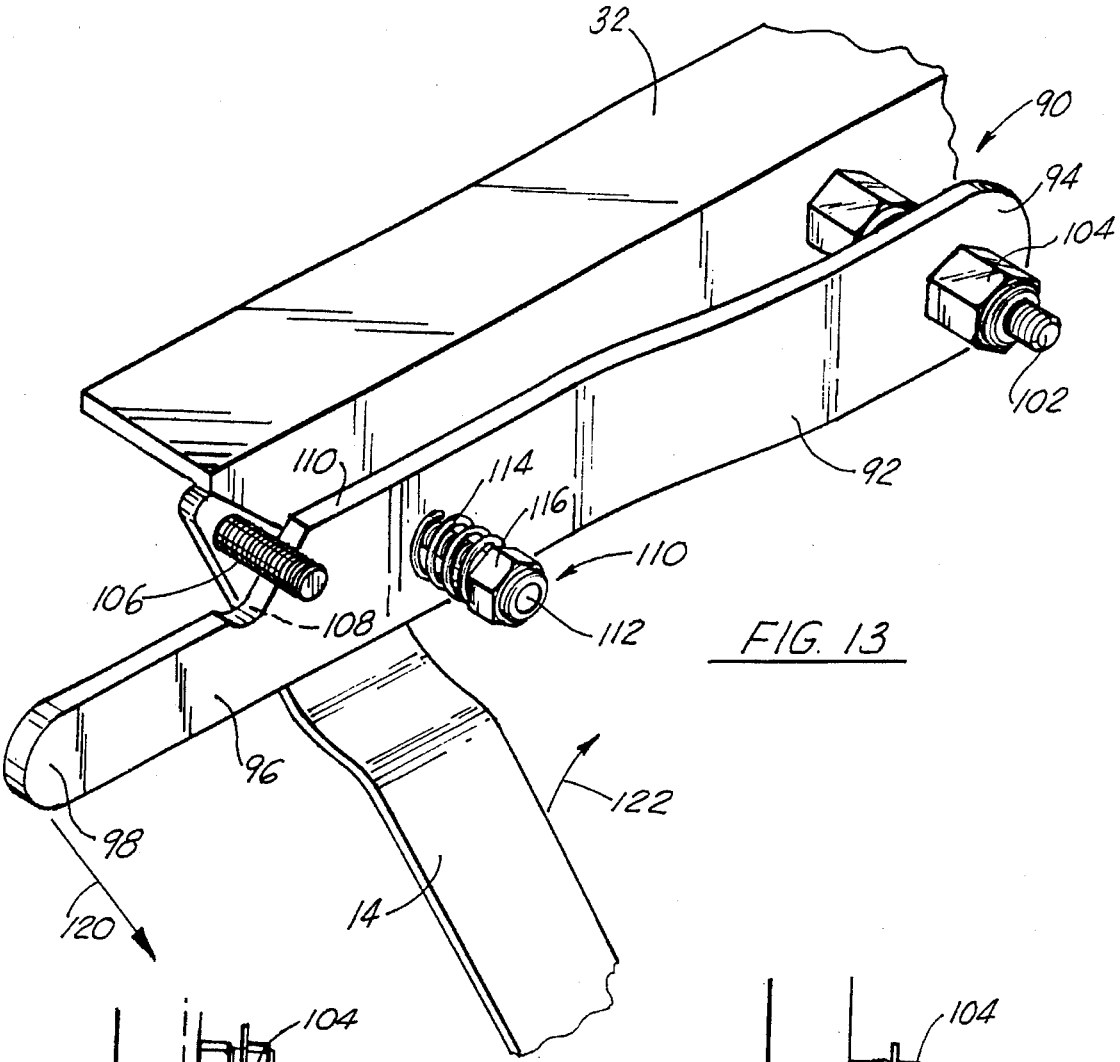
FIGS. 13–15 illustrate an additional embodiment of the locking mechanism in the preferred embodiment of the present invention.
Figure 14:
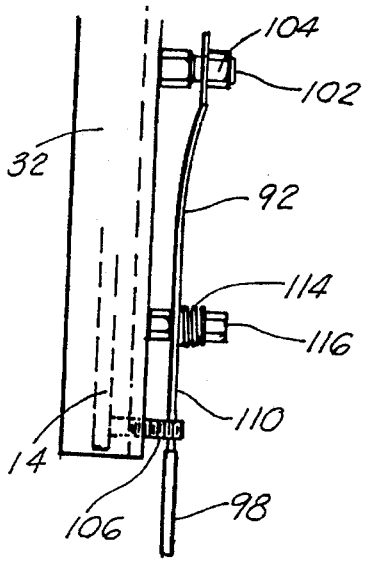
Figure 15:
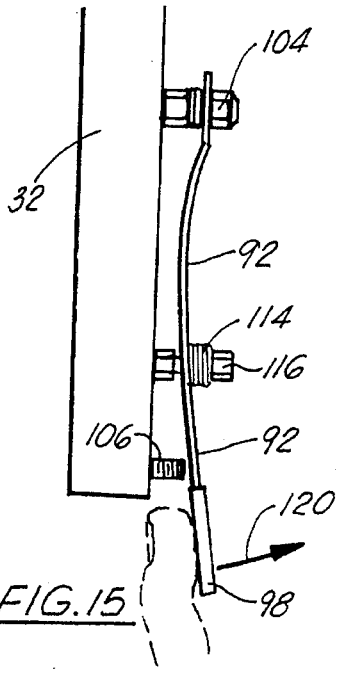

An additional embodiment of the locking means is illustrated in FIGS. 13–15. As illustrated, locking means 90 would comprise a principal locking arm 92 having a first end 94 secured to one L bracket 32 which is secured to the lower seat face 29 of stool 10. Locking arm 92 has a second end 96 which has a end portion 98 for grasping during locking and unlocking of the seat. The locking arm 92 is secured by bolt 102 through the bracket 32 and held in place by nut 104. There is provided a locking pin 106 extending out of one of the legs 14. Locking arm 92 is held flush against the bracket 32 by a support member 110 which comprises a second bolt 112 and a spring 114 with spring 114 held in place by nut 116. Therefore, spring 114 biases locking arm 92 against the face of bracket 32 as illustrated in FIGS. 13 and 14 when the stool is in the locked position. When the seat of the stool tends to be folded down, the end portion 98 of arm 92 is moved in the direction of arrow 120, as illustrated in FIG. 15, and arm 92 is therefore moved out of locking position against pin 106. When that occurs, leg 14 is allowed to fold inward so that stool may fold up in the position as seen in FIG. 4. Of course, when one wants to return the stool to the opened position, leg 14 is again swung upward in the direction of arrow 122, and the end 98 of arm 92 again is swung outward as seen in FIG. 15, and when the pin has cleared the arm portion 96, the arm is returned to the position as seen in FIG. 14 and the locking pin engages recess 108 so that the stool 10 is maintained in the opened locked position.

The following table lists the part numbers and part descriptions as used herein and in the drawings attached hereto.

PARTS LIST

| Part Number | Description |
|---|---|
| 10 | stool |
| 12 | support means |
| 14 | leg members |
| 15 | wooden top portion |
| 16 | first pair of leg members |
| 17 | arrows |
| 18 | second pair of leg members |
| 20 | common point |
| 21 | hinge members |
| 22 | cap member |
| 23 | floor |
| 24 | upper ends |
| 26 | support bar |
| 28 | end caps |
| 29 | lower seat face |
| 30 | swivel attachment means |
| 32 | "L" brackets |
| 33 | screws |
| 34 | first bracket swivel |
| 36 | second bracket swivel |
| 38 | swivel plates |
| 40 | seat upper face |
| 41 | second end |
| 42 | handle means |
| 43 | arrows |
| 44 | handle means |
| 60 | flexible locking member |
| 62 | first end |
| 64 | screw |
| 66 | elongated body portion |
| 68 | triangulated top portion |
| 70 | lower shoulder portion |
| 71 | beveled edge |
| 72 | arrow |
| 74 | arrow |

-continued

PARTS LIST

| Part Number | Description |
|---|---|
| 75 | bore |
| 76 | arrow |
| 77 | bore |
| 80 | pin member |
| 82 | cap |
| 84 | second end of pin member |
| 86 | spring member |
| 90 | locking means |
| 92 | locking arm |
| 94 | first end |
| 96 | second end |
| 98 | end portion |
| 102 | bolt |
| 104 | nut |
| 106 | locking pin |
| 108 | recess |
| 110 | support member |
| 112 | second bolt |
| 114 | spring |
| 116 | nut |
| 120 | arrow |

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A collapsible stool apparatus, comprising:

a) support means comprising a first and second pair of leg members for moving from a first closed parallel position to a second opened position with the first and second pair of leg means crossing to form an "X" configuration;

b) an upper seat further comprising a wooden seat attached directly to the support means;

c) attachment means positioned intermediate the leg members and the seat portion for allowing the leg members to swivel from the first parallel position to the second "X" configured opened position;

d) a handle member attached to and extending from a lower face of the seat for allowing the apparatus to be carried by a user while the apparatus is in the closed position and is positioned beneath the seat when the apparatus is in the opened position; and e) locking means for engaging the upper leg members against the seat means so as to avoid the leg members from inadvertently moving to the second open position when the stool is sat upon, the locking means further comprising a removable pin member engageable into a pair of bores in the leg members so that once engaged, engages the leg members to the upper support portion, and prevents the leg members from moving from the first closed position to the second open position.

2. The stool apparatus in claim 1, wherein the lower support means is attached to the seat portion with wood screws or the like.

3. The stool apparatus in claim 1, wherein in the closed position, the apparatus conforms to a substantially flat, compact position for easy storage and shipment.

4. The apparatus of claim 1, wherein the seat portion may be circular, triangular, oval shaped, or square.

5. The apparatus in claim 1, wherein the leg members while in the open position form a broad based support for supporting a user.

6. A collapsible stool apparatus comprising:

a) a lower support portion further comprising a plurality of leg members which move from a first parallel closed position to a second "x" configured opened position for use by a user;

b) an upper support portion further comprising a wooden plate threadably attached to the lower support bracket portions for use as an upper portion of a stool or the upper surface of a table;

c) a swivel plate interconnecting the lower support in the seat portion, so that the swivel plate means allows the legs to be configured from the opened to the closed positions;

d) a handle member secured to a lower face of the upper support portion so that when the stool is in the closed configuration, the handle member may be used to carry the apparatus and when the stool is in the open configuration the handle member is positioned beneath the support portion; and e) locking means for engaging an upper portion of the leg members against the upper support portion so as to prevent the leg members from inadvertently moving to the closed position when the stool is sat upon, the locking means further comprising a removable pin member engageable into a pair of bores in the leg members so that once engaged, engages the leg members to the upper support portion, and prevents the leg members from moving from the first closed position to the second open position.

* * * * *